US005126064A

United States Patent [19]

Barber et al.

[11] Patent Number: 5,126,064

[45] Date of Patent: Jun. 30, 1992

[54] LUBRICANT COMPOSITIONS

[75] Inventors: Rodney I. Barber, Bracknell; Charles J. Dain, Basingstoke; David K. Walters, Camberley, all of England

[73] Assignee: Ethyl Petroleum Additives, Ltd., Bracknell, England

[21] Appl. No.: 525,323

[22] Filed: May 17, 1990

[30] Foreign Application Priority Data

May 22, 1989 [GB] United Kingdom ..... 8911732

[51] Int. Cl.[5] ..... C10M 133/44

[52] U.S. Cl. ..... 252/47.5; 252/49.9; 252/51.5 A

[58] Field of Search ..... 252/32.7 E, 51.5 A, 252/47.5, 49.9

[56] References Cited

U.S. PATENT DOCUMENTS 3,219,666 11/1965 Norman et al. ..... 252/51.5 A
4,521,318 6/1985 Karol ..... 252/51.5 A
4,839,071 6/1989 Gutierrez et al. ..... 252/51.5 A
5,021,176 6/1991 Bullen et al. ..... 252/51.5 A

FOREIGN PATENT DOCUMENTS 0020037 10/1980 European Pat. Off. .
1111837 5/1968 United Kingdom .

OTHER PUBLICATIONS

Smalheer et al.; "Lubricant Additives" pp. 9-11; 1967.

*Primary Examiner*—Jacqueline Howard
*Attorney, Agent, or Firm*—John F. Sieberth

[57] ABSTRACT

Lubricant compositions, especially suitable for limited slip differentials, containing sulphur-containing extreme pressure or anti-wear agents, are improved by incorporation of a substituted succinimide friction modifier. The resulting compositions reduce the level of noise produced during operation of the differential.

18 Claims, No Drawings

LUBRICANT COMPOSITIONS

This invention relates to lubricant compositions suitable for the lubrication of gears and in particular for the lubrication of limited slip differentials.

The drive systems of motor vehicles generally incorporate so-called differential gears which are bevel gear or spur gear planetary systems which distribute the drive torque evenly to the two driving wheels irrespective of their rotational speed. This makes it possible for the driven wheels to roll during cornering without slip between the wheel and road surface in spite of their different rotational speed. Where more than one axle is driven, not only the driven wheels themselves but also the drive shafts to the wheels must be connected by means of a differential gear system in order to provide uniform load distribution. However, differential gear systems suffer from the disadvantage that if, for any reason, one of the driven wheels slips, e.g. because it is on ice or mud, all the power is transmitted to this wheel and the other wheels with better grip remain stationary. To avoid this problem it is customary to provide so-called limited slip differential gear systems in which part of the driving torque is transmitted to wheels via a friction clutch rather than the differential gear system itself. With a limited slip differential, even if one wheel slips, a proportion of the torque is still transmitted to the other wheels.

Limited slip differentials generally comprise a series of clutch plates which are immersed in a lubricant. The clutch plates are predominantly metal on metal (steel on steel or steel on phosphor bronze), but steel on paper compounds are sometimes used.

Limited slip differentials are especially important in four-wheel drive vehicles which have become increasingly popular in recent years for road vehicles as well as in off-road or mixed surface vehicles, because of the better handling which four-wheel drive confers on the vehicle.

One disadvantage of limited slip differentials is that the inevitable slipping of the clutch plates during operation of the differential generates noise.

The present invention provides a lubricant composition especially suitable for use for lubricating limited slip differentials which reduces the noise generated by slipping of the clutch plates during operation of the differential without adversely affecting the performance of the differential.

The lubricant composition of the present invention comprises a lubricant, 1 to 20% by weight of one or more sulphur-containing extreme pressure or anti-wear agents, and from 0.05 to 1.5% by weight of a compound having the structure

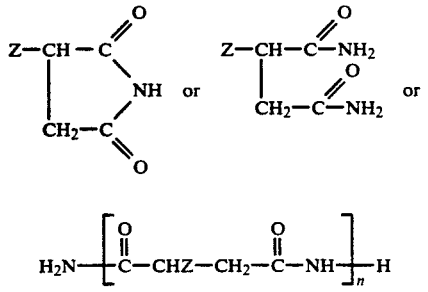

wherein n is an integer from 2 to 4 and wherein Z has the structure $R_1R_2CH$— wherein $R_1$ and $R_2$ are each independently straight or branched chain hydrocarbon groups containing from 1 to 34 carbon atoms such that the total number of carbon atoms in the groups $R_1$ and $R_2$ is from 11 to 35. The radical Z may be, for example, 1-methylpentadecyl, 1-propyltridecenyl, 1-pentyltridecenyl, 1-tridecylpentadecenyl, or 1-tetradecyleicosenyl.

These compounds are made from linear α-olefins containing from 12 to 36 carbon atoms by isomerizing the α-olefins to form a mixture of internal olefins and reacting this mixture of internal olefins with maleic acid, anhydride or ester forming an intermediate and reacting the intermediate with ammonia to form amide, imide, or mixtures thereof. Compounds made from isomerized linear α-olefins have greatly improved oil solubility compared with compounds made with linear α-olefins. These compounds are described in European Specification No. 0020037 to which reference may be made for a detailed description.

While it is possible to include small amounts of metal-containing additive components in the lubricant compositions of this invention, it is highly preferred to provide lubricant compositions which are essentially devoid of metal-containing additive components. Besides enabling the achievement of desirable limited slip performance, such essentially metal-free compositions make possible the provision of gear oils satisfying the requirements of the GL5 classification of the American Petroleum Institute. Thus the preferred lubricant compositions of this invention do not contain such metal-containing additives as the zinc dihydrocarbyldithiophosphates or the sulphonates, phenates, and/or sulphurised phenates of the alkali metals or of the alkaline earth metals, components which are almost universally employed in engine oils.

The lubricant may be a mineral oil, a synthetic oil, a natural oil such as a vegetable oil, or a mixture thereof, e.g. a mixture of a mineral oil and a synthetic oil. Suitable mineral oils include those of appropriate viscosity refined from crude oil of any source including Gulf Coast, Midcontinent, Pennsylvania, California, Alaska, Middle East, North Sea and the like. Standard refinery operations may be used in processing the mineral oil.

Synthetic oils include both hydrocarbon synthetic oils and synthetic esters. Useful synthetic hydrocarbon oils include liquid alpha olefin polymers of appropriate viscosity. Especially useful are hydrogenated liquid oligomers of $C_6$–$C_{16}$ alpha-olefins, such as alpha-decene trimer. Alkyl-benzenes of appropriate viscosity, e.g. didodecylbenzene, can also be used.

Useful synthetic esters include the esters of monocarboxylic and polycarboxylic acids with monohydroxy alcohols and polyols. Typical examples are didodecyl adipate, trimethylolpropane tripelargonate, pentaerythritol tetracaproate, di(2-ethylhexyl) adipate, and dilauryl sebacate. Complex esters made from mixtures of mono- and di-carboxylic acids and mono-and/or polyhydric alkanols can also be used.

Blends of mineral oil with synthetic oil are particularly useful. For example, blends of 5 to 25 weight percent hydrogenated α-decene with 75 to 95 weight percent mineral oil results in an excellent lubricant. Likewise, blends of about 5 to 25 weight percent synthetic ester with mineral oil of proper viscosity results in a superior lubricating oil. Also blends of synthetic hydrocarbon oil with synthetic esters can be used. Blends of mineral oil with synthetic oil are especially useful when preparing low viscosity oil (e.g. SAE 75W90).

The new lubricant compositions may be supplied either as finished lubricants ready for use or in the form of an additive package, i.e. a concentrate, which requires dilution with base lubricating fluid before use. As described in more detail below, the lubricant compositions of the invention may contain, in addition to the substances already mentioned, any usual additive, most preferably any metal-free additive, for inclusion in such lubricants which is compatible therewith. Examples of such additives are given below.

A very wide variety of sulphur-containing oil-soluble extreme pressure or antiwear agents may be used in the compositions of the invention, and any known such agents may in principle be used. Examples of such agents are sulphurised olefins, sulphurised esters, sulphurised fatty acids, dialkylpolysulphides, sulphur, thio-derivatives of alkylphosphites, amine salts of sulphur-containing phosphorus acids such as the amine salts of mono-, di-, tri-, and tetrathiophosphoric acids, and esters of such sulphur-containing phosphorus acids.

At least one of the agents used in the compositions of the present invention contains sulphur and in the preferred compositions of the invention the sulphur atoms in the sulphur-containing species are bound directly to carbon or to more sulphur.

One preferred class of such agents is made by reacting an olefin such as isobutene with sulphur. The product, e.g., sulphurised isobutene, typically has a sulphur content of about 10 to about 50%, preferably 30 to 50%, by weight. A wide variety of other olefins or unsaturated hydrocarbons, e.g., isobutene dimer or trimer, may be used to form such agents.

Another preferred class of such agents is composed of one or more compounds represented by the formula $$R—S_x—R'$$

where R and R' are hydrocarbyl groups each of which preferably contains 3 to 18 carbon atoms and x is preferably in the range of from 3 to 12, and more preferably in the range of from 3 to 8. The hydrocarbyl groups can be of widely varying types such as alkyl, cycloalkyl, alkenyl, aryl, aralkyl, etc. Tertiary alkyl polysulphides such as di-tert-butyl trisulphide, and mixtures comprising di-tert-butyl trisulphide (e.g. a mixture composed principally or entirely of the tri-, tetra-, and pentasulphides) are preferred. Examples of other useful dihydrocarbyl polysulphides include the diamyl polysulphides, the nonyl polysulphides, the didodecyl polysulphides, and the dibenzyl polysulphides, among others.

Other preferred sulphur-containing extreme pressure agents which may be used in the compositions of the invention are sulphur and the sulphur- and phosphorus-containing additives already mentioned, especially the thiophosphates, dithiophosphates, trithiophosphates and tetrathiophosphates, e.g., the fully or partially esterified hydrocarbyl esters of the mono-, di-, tri-, and tetrathiophosphoric acids, and the amine salts of the partially esterified mono-, di-, tri-, and tetrathiophosphoric acids. The aforesaid hydrocarbyl groups may each typically contain 2 to 30, preferably 4 to 12, carbon atoms each.

The proportion of sulphur-containing extreme pressure or antiwear agent included in the compositions of the invention is 1 to 20% by weight, usually 2–10%, based on the weight of the lubricant.

The new compositions preferably contain a phosphorus-containing extreme pressure or antiwear agent. As already indicated the sulphur-containing agent may itself contain phosphorus, or a separate phosphorus-containing agent may be used with the sulphur-containing agent (which may itself contain phosphorus). Such separate phosphorus-containing agents include derivatives of phosphorus oxyacids and of polyphosphorus oxyacids such as phosphites, phosphates and pyrophosphates, and especially their oil-soluble esters, acid esters and amine salts. Preferably a mono- or di-hydrocarbyl phosphite or phosphate or a mixture thereof is used, where the hydrocarbyl groups may be alkyl, alkenyl, phenyl, alkylphenyl or dialkylphenyl. Examples of suitable esters are monoisopropyl, diisopropyl, mono-n-butyl, di-n-butyl, mono-isobutyl, di-isobutyl, monoamyl, diamyl, di-n-octyl, di-(2-ethyl-n-hexyl), monooleyl, dioleyl, monophenyl, diphenyl and di(dodecylphenyl) phosphite and phosphate, and their amine salts. Such phosphorus-containing agents are usually included in the new compositions in a proportion of 0.01 to 7.5%, preferably 0.1 to 3.5%, based on the weight of the lubricant.

The compositions of the present invention normally include an amine in an amount from 0.005 to 10%, preferably 0.1 to 2%, by weight of the lubricant. Preferred amines are aliphatic mono and polyamines containing 2 to 22 carbon atoms per molecule. Primary, secondary and tertiary amines are all suitable. Especially preferred amines are linear or branched aliphatic, cycloaliphatic or ethylenically unsaturated aliphatic amines of 6 to 22 carbon atoms, e.g. n-octylamine, oleylamine, cyclohexylamine, polyethylene polyamines such as triethylene tetramine, and the tertiary alkyl primary amines sold under the trade names Primene 81-R and Primene JM-T.

The compositions of the invention may include an acid, preferably one having a pKa of greater than about 2.0, in an amount up to 10% by weight of the lubricant, preferably 0.1 to 2% by weight. Such acid is usually a carboxylic acid in which one or more carboxyl groups are attached to a hydrocarbon radical of 1 to 100, preferably 2 to 36 carbon atoms. Examples of suitable acids are alkanoic and alkenoic mono, di- or poly-carboxylic acids of 1 to 100, preferably 2 to 54, carbon atoms, e.g. acetic acid, n-octanoic acid, oleic acid, tetrapropenylsuccinic acid or dimerised or trimerised linoleic acid. The acid used must be such as to form an oil-soluble salt with the amine used.

The combined proportions of the carboxylic acid and of the amine used are typically from 0.005 to 20.0% by weight of the lubricant, preferably 0.1 to 4.0%. Instead of a mixture of acid and amine, an amino-acid may be used in the same total amount as a percentage based on the weight of the lubricant, i.e. 0.005 to 20% based on the weight of the lubricant. Suitable amino-acids include glycine, alanine, and phenylalanine.

The compositions of the invention may contain other additives suitable for use in gear oils, for example:

Antioxidants

Hindered phenols, amines and various organic compounds containing nitrogen, sulphur, or phosphorus. The antioxidants are preferably secondary aromatic amines such as are described in British 1,332,201 and U.S. Pat. No. 4,824,601 and/or sterically-hindered alkyl phenols such as are described in U.S. Pat. Nos. 2,944,086; 3,043,775; 3,166,509; and 3,211,652. Especially desirable are mixtures of hindered phenols such as 2,6-di-tert-butyl phenol, 2,4,6-tri-tertbutyl phenol, 4,4'-methylenebis(2,6-di-tert-butyl phenol), etc., and aromatic secondary amines such as bis(p-nonylphenyl)amine, phenyl-alpha-naphthylamine, phenyl-beta-naphthylamine, etc.

Antifoamants and demulsification agents

Silicon based fluids, ethylene glycol-propylene glycol condensation products, polyalkylacrylate.

Dispersants

Polyalkenyl succinimides, succinate esters, and N-vinylpyrrolidone-methacrylate ester copolymers.

Suitable dispersants include more particularly ashless dispersants, such as a polyolefin succinamide or succinimide of a polyethylene polyamine such as tetraethylenepentamine. The polyolefin succinic substitutent is preferably a polyisobutene group having a molecular weight of from about 800 to 5,000. Such ashless dispersants can, if desired, be post-treated in accordance with procedures known in the art. Examples of suitable succinimide-type ashless dispersants, including posttreated dispersants, and methods for their preparation are set forth and described for example, in the following:

| | | |
|---|---|---|
| U.S. Pat. No. 3,018,247; | U.S. Pat. No. 3,018,250; | U.S. Pat. No. 3,018,291; |
| U.S. Pat. No. 3,087,936; | U.S. Pat. No. 3,172,892; | U.S. Pat. No. 3,184,411; |
| U.S. Pat. No. 3,184,474; | U.S. Pat. No. 3,185,645; | U.S. Pat. No. 3,185,704; |
| U.S. Pat. No. 3,194,812; | U.S. Pat. No. 3,194,814; | U.S. Pat. No. 3,200,107; |
| U.S. Pat. No. 3,202,678; | U.S. Pat. No. 3,215,707; | U.S. Pat. No. 3,219,666; |
| U.S. Pat. No. 3,231,587; | U.S. Pat. No. 3,254,025; | U.S. Pat. No. 3,256,185; |
| U.S. Pat. No. 3,272,746; | U.S. Pat. No. 3,278,550; | U.S. Pat. No. 3,280,034; |
| U.S. Pat. No. 3,281,428; | U.S. Pat. No. 3,282,955; | U.S. Pat. No. 3,284,410; |
| U.S. Pat. No. 3,287,271; | U.S. Pat. No. 3,311,558; | U.S. Pat. No. 3,312,619; |
| U.S. Pat. No. 3,331,776; | U.S. Pat. No. 3,338,832; | U.S. Pat. No. 3,341,542; |
| U.S. Pat. No. 3,344,069; | U.S. Pat. No. 3,346,354; | U.S. Pat. No. 3,347,645; |
| U.S. Pat. No. 3,361,673; | U.S. Pat. No. 3,366,569; | U.S. Pat. No. 3,367,943; |
| U.S. Pat. No. 3,369,021; | U.S. Pat. No. 3,373,111; | U.S. Pat. No. 3,381,022; |
| U.S. Pat. No. 3,390,086; | U.S. Pat. No. 3,399,141; | U.S. Pat. No. 3,401,118; |
| U.S. Pat. No. 3,458,530; | U.S. Pat. No. 3,470,098; | U.S. Pat. No. 3,502,677; |
| U.S. Pat. No. 3,511,780; | U.S. Pat. No. 3,513,093; | U.S. Pat. No. 3,541,012; |
| U.S. Pat. No. 3,551,466; | U.S. Pat. No. 3,558,743; | U.S. Pat. No. 3,573,205; |
| U.S. Pat. No. 3,576,743; | U.S. Pat. No. 3,578,422; | U.S. Pat. No. 3,652,616; |
| U.S. Pat. No. 3,658,494; | U.S. Pat. No. 3,658,495; | U.S. Pat. No. 3,718,663; |
| U.S. Pat. No. 3,749,695; | U.S. Pat. No. 3,865,740; | U.S. Pat. No. 3,865,813; |
| U.S. Pat. No. 3,912,764; | U.S. Pat. No. 3,954,639; | U.S. Pat. No. 4,110,349; |
| U.S. Pat. No. 4,234,435; | U.S. Pat. No. 4,338,205; | U.S. Pat. No. 4,401,581; |
| U.S. Pat. No. 4,410,437; | U.S. Pat. No. 4,428,849; | U.S. Pat. No. 4,548,724; |
| U.S. Pat. No. 4,554,086; | U.S. Pat. No. 4,608,185; | U.S. Pat. No. 4,612,132; |
| U.S. Pat. No. 4,614,603; | U.S. Pat. No. 4,615,826; | U.S. Pat. No. 4,645,515; |
| U.S. Pat. No. 4,710,201; | U.S. Pat. No. 4,713,191; | U.S. Pat. No. 4,746,446; |
| U.S. Pat. No. 4,747,850; | U.S. Pat. No. 4,747,963; | U.S. Pat. No. 4,747,964; |
| U.S. Pat. No. 4,747,965; | U.S. Pat. No. 4,857,214; | British 1,085,903 |
| and British 1,162,436. | | |

Other useful ashless dispersants include the Mannich condensation products of polyolefin substituted phenols, formaldehyde and polyethylene polyamine. Preferably, the polyolefin phenol is a polyisobutylene-substituted phenol in which the polyisobutylene group has a molecular weight of from about 800 to 5,000. The preferred polyethylene polyamine is tetraethylene pentamine. Such Mannich ashless dispersants are more fully described in U.S. Pat. No. 3,368,972;

| | | |
|---|---|---|
| U.S. Pat. No. 3,413,347; | U.S. Pat. No. 3,442,808; | U.S. Pat. No. 3,448,047; |
| U.S. Pat. No. 3,539,633; | U.S. Pat. No. 3,591,598; | U.S. Pat. No. 3,600,372; |
| U.S. Pat. No. 3,634,515; | U.S. Pat. No. 3,697,574; | U.S. Pat. No. 3,703,536; |
| U.S. Pat. No. 3,704,308; | U.S. Pat. No. 3,725,480; | U.S. Pat. No. 3,726,882; |
| U.S. Pat. No. 3,736,357; | U.S. Pat. No. 3,751,365; | U.S. Pat. No. 3,756,953; |
| U.S. Pat. No. 3,793,202; | U.S. Pat. No. 3,798,165; | U.S. Pat. No. 3,798,247 and |
| U.S. Pat. No. 3,803,039. | | |

Viscosity index improvers or pour point depressants

Polyalkylmethacrylates or olefin copolymers.

Other Friction Modifiers

Alkyl or alkenyl fatty acid amides, or alkyl or alkenyl phosphonates.

Metal Deactivators

Thiadiazole derivatives, benzotriazole, or benzotriazole derivatives.

The invention includes within its scope lubricant additive concentrates comprising 5 to 80% of one or more sulphur-containing extreme pressure or anti-wear agents, and from 0.25 to 15% of at least one succinimide derivative having the structure

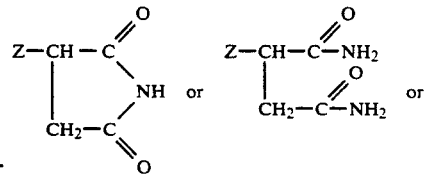

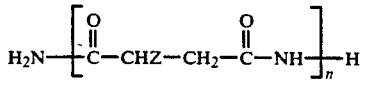

wherein n is an integer from 2 to 4 and wherein Z has the structure $R_1R_2CH$— wherein $R_1$ and $R_2$ are each independently straight or branched chain hydrocarbon groups containing from 1 to 34 carbon atoms and the total number of carbon atoms in the groups $R_1$ and $R_2$ is from 11 to 35, and a diluent oil, the said percentages being by weight based on the total weight of the concentrate. Such concentrates may also contain 0.1 to 50% of one or more phosphorus-containing extreme pressure or anti-wear agents, and 0.05 to 20% of an amine as described above plus 0 to 20% of a weak acid (or 0.05 to 40% of an amino acid). Other additives suitable for use in gear oils such as those mentioned above may also be included.

The compositions of the invention can conveniently be made by modification of existing compositions by adding appropriate amounts of acid and amine thereto.

The following Examples illustrate the invention.

EXAMPLES

Sulphur/phosphorus additive package A is an additive package suitable for making gear oils to American Petroleum Institute classifications GL4 and GL5. It contains 31% of sulphur. It is made by incorporating sulphurised iso-butylene containing 45±3% by weight of sulphur and an alkylamine/alkyl phosphate/alkyl phosphite/alkyl thiophosphate mixture together with carboxylic acids and metal deactivators into a suitable mineral oil base.

Sulphur/phosphorus additive package B is similar to package A but contains 23% of sulphur and in addition an alkyl dithiophosphate.

Lubricant Blend 1 of SAE 90 grade viscosity characteristics was obtained by adding additive package A to a high viscosity index paraffinic mineral oil at a concentration of 8%.

Blend 2 was the same as Blend 1 but contained in addition 0.5% by weight of a succinimide friction modifier as defined above in which Z is alkenyl having an average of 22 carbon atoms.

Blend 3 was made by incorporating, into the same high viscosity index paraffinic mineral oil, 7.4% of additive package A plus 0.32% by weight of dimethyl octadecyl phosphonate (a known friction modifier).

Blend 4 was obtained by adding, to the same high viscosity index paraffinic mineral oil, 7.6% of additive package B together with 0.5% of the succinimide friction modifier used in Blend 2.

Blend 5 was made by incorporating, into a high viscosity index 20:70 mixed ester/paraffinic mineral oil base stock, 8.0% of additive package A.

Blend 6 was the same as Blend 5 but included also 0.25% by weight of the same succinimide friction modifier as in Blend 2.

Blend 7 was made by incorporating, into the same mixed ester/mineral oil base stock, 8.3% of additive package A and 0.24% of dimethyl octadecyl phosphonate (a known friction modifier).

The succinimide friction modifier used in Blends 2, 4 and 6 was used in admixture with a polybutenyl succinimide ashless dispersant concentrate in a weight ratio of 1:2.

The blends described above were tested for their ability to reduce noise generation in an apparatus which included a limited slip differential unit driven by a system which simulated the normal operation of the limited slip aspects of the unit in use. An acoustic microphone was located next to the unit to make possible measurement of the noise generated by the limited slip differential during operation of the unit. Noise was measured either over the whole aural range (dbA) or over a limited range of frequencies centered at 2 kiloHerz (dbF).

Over the whole aural range noise generation using Blend 2 was 4 dB less than that generated using Blend 1. Blend 3, on the other hand, showed no reduction in noise level over the whole aural range as compared with Blend 1.

Blend 4 similarly showed a reduction in noise generation of 3 dB as compared with that generated using Blend 1.

Over the whole aural range, noise generation using Blends 5, 6 and 7 were similar. However, in the important 2 kiloHerz range, Blend 6 reduced noise generation by 10 dB as compared with that generated using Blends 5 and 7, which gave similar results.

We claim:

1. A lubricant composition comprising a lubricant 1 to 20% by weight of one or more sulphur-containing extreme pressure or anti-wear agents, and from 0.05 to 1.5% by weight at least one succinimide derivative having the structure

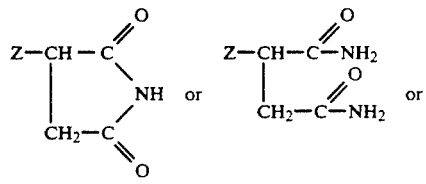

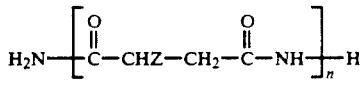

wherein n is an integer from 2 to 4 and wherein Z has the structure $R_1R_2CH$— wherein $R_1$ and $R_2$ are each independently straight or branched chain hydrocarbon groups containing from 1 to 34 carbon atoms and the total number of carbon atoms in the groups $R_1$ and $R_2$ is from 11 to 35 composition, wherein the lubricant composition is substantially devoid of any metal-containing component.

2. A composition according to claim 1 in which the said succinimide derivative includes one or more of 1-methylpentadecyl succinimide, 1-propyltridecenyl succinimide, 1-pentyltridecenyl succinimide, 1-tridecylpentadecenyl succinimide or 1-tetradecyleicosenyl succinimide.

3. A composition according to claim 1 containing 2 to 10% by weight of the said sulphur-containing extreme pressure or antiwear agent based on the weight of the lubricant.

4. A composition according to claim 3 in which the said sulphur-containing extreme pressure or antiwear agent contains 30 to 50% by weight of sulphur.

5. A composition according to claim 4 in which the said sulphur-containing extreme pressure or antiwear agent is sulphur, sulphurised olefin, sulphurised ester, sulphurised fatty acid, or dialkyl polysulphide.

6. A composition according to claim 5 in which the said agent is sulphurised isobutene.

7. A composition according to claim 1 in which the sulphur-containing extreme pressure or antiwear agent includes at least one sulphur-containing phosphite or phosphate ester.

8. A composition according to claim 1 which contains in addition to a sulphur-containing extreme pressure or antiwear agent, 0.01 to 7.5% by weight of a phosphorus-containing extreme pressure or antiwear agent.

9. A composition according to claim 8 in which the said phosphorus-containing agent is a mono- or dihydrocarbyl phosphite or phosphate or a mixture thereof.

10. A composition according to claim 1 which also contains a polyolefin succinamide or succinimide of a polyethylene polyamine in which the polyolefin is a polyisobutene having a molecular weight of from about 800 to 5000.

11. A composition according to any one of claims 1 to 10 which also contains 0.005 to 10.0% by weight of an amine and 0 to 10% by weight of a weak acid, or 0.005 to 20% by weight of an amino acid, based on the weight of the lubricant.

12. A lubricant additive concentrate comprising 5 to 80% of one or more sulphur-containing extreme pressure or anti-wear agents, and from 0.25 to 15% of at least one succinimide derivative having the structure

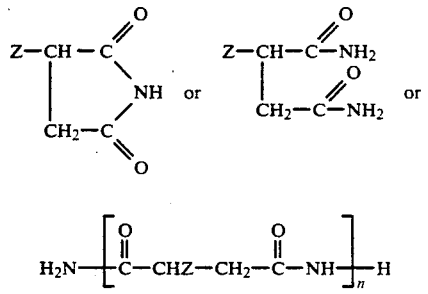

wherein n is an integer from 2 to 4 and wherein Z has the structure $R_1R_2CH$— wherein $R_1$ and $R_2$ are each independently straight or branched chain hydrocarbon groups containing from 1 to 34 carbon atoms and the total number of carbon atoms in the groups $R_1$ and $R_2$ is from 11 to 35, and a diluent oil, the said percentages being by weight based on the total weight of the concentrate.

13. A lubricant additive concentrate according to claim 12 which also contains 0.1 to 50% of one or more phosphorus-containing extreme pressure or anti-wear agents.

14. A lubricant additive concentrate according to claim 12 which also contains a polyolefin succinamide or succinimide of a polyethylene polyamine in which the polyolefin is a polyisobutene having a molecular weight of from about 800 to 5000.

15. A lubricant additive concentrate according to claim 12, 13 or 14 which also contains 0.05 to 20% by weight of an amine and 0 to 20% by weight of a weak acid, or from 0.05 to 40% by weight of an amino-acid.

16. A composition in accordance with any of claims 1, 6, 8, or 10 wherein said succinimide derivative is produced by reacting maleic acid, maleic anhydride, or a maleic acid ester with a mixture of olefins formed by isomerizing linear α-olefins containing from 12 to 36 carbon atoms to form an intermediate which is then reacted with ammonia.

17. A method of reducing noise generated by slipping of clutch plates during the operation of a limited slip differential which comprises providing as the lubricant for such differential, a lubricant composition in accordance with any of claims 1, 6, 8 or 10.

18. A limited slip differential which comprises a series of clutch plates immersed in a lubricant composition, said lubricant composition being in accordance with any of claims 1, 6, 8 or 10.

* * * * *